United States Patent [19]

Nyitray et al.

[11] 3,973,758

[45] Aug. 10, 1976

[54] CONVEYING AND MIXING APPARATUS

[75] Inventors: William Nyitray, Chicago; Robert L. Francke, Cary, both of Ill.

[73] Assignee: Northwest Molded Products Corporation, Waukegan, Ill.

[22] Filed: Feb. 10, 1975

[21] Appl. No.: 548,594

[52] U.S. Cl. ..... 259/6; 222/142; 259/161

[51] Int. Cl.[2] ..... B01F 7/08

[58] Field of Search ..... 259/6, 21, 41, 64, 154, 259/161, 162, 164, 165, 169, 179, DIG. 24; 222/136, 142, 145; 198/64, 213

[56] References Cited

UNITED STATES PATENTS

| | | | |
|---|---|---|---|
| 2,028,745 | 1/1936 | Hendrick et al. | 259/169 X |
| 2,086,181 | 7/1937 | Bonotto | 198/213 X |
| 3,184,112 | 5/1965 | Loeser | 222/145 X |
| 3,773,098 | 11/1973 | Rock | 222/145 X |

FOREIGN PATENTS OR APPLICATIONS

| | | | |
|---|---|---|---|
| 2,024,687 | 12/1971 | Germany | 222/136 |

*Primary Examiner*—Billy J. Wilhite
*Assistant Examiner*—James A. Niegowski
*Attorney, Agent, or Firm*—Kinzer, Plyer, Dorn & McEachran

[57] ABSTRACT

A mixing and conveying apparatus for dry materials, such as granules and powders, which mixes these materials uniformly in desired proportions and conveys them after mixing to desired elevated locations such as feed or storage containers, or the intakes of processing machines. The apparatus includes first and second auger conveyors which are positioned parallel to one another and extend generally in an upright direction. The first auger conveyor has an inlet at the lower end thereof and an outlet near the upper end thereof. The second auger conveyor has its outlet near the upper end thereof. A chamber connects the outlet of the first auger conveyor with the inlet of the second auger conveyor and this chamber extends on an incline between the conveyors. An opening is provided into the chamber for the introduction of additional materials which mix with the first material by gravity before the comingled materials reach the inlet of the second auger conveyor. The second auger conveyor has a greater transporting capacity than the first auger conveyor and thus draws material out of the mixer chamber faster than the first auger conveyor delivers material to the mixer chamber. In order to insure thorough mixing of the materials, the first material is discharged into the mixer chamber while moving in an upwardly direction while the additional materials are introduced into the mixer chamber while moving in an downwardly direction.

4 Claims, 3 Drawing Figures

65
67
63
21
61
41
39
55
15
11
49
17
13
29
27

CONVEYING AND MIXING APPARATUS

SUMMARY OF THE INVENTION

This invention is concerned with a conveying and mixing apparatus and particularly with an apparatus which will mix dry materials uniformly and in preselected proportions and will convey the uniformly mixed materials to storage or feed locations, or the intakes of processing machines which may be elevated.

An object of this invention is a conveying and mixing apparatus for dry materials in which the materials are mixed by gravity while the materials are falling down an incline.

Another object is a mixing and conveying apparatus in which the ratios between the dry materials being mixed can easily be adjusted.

Another object is a conveying and mixing apparatus having a pair of auger conveyors connected in series by a mixing housing in which the second conveyor has a greater transporting capacity than the first conveyor so that a cavitation is created in the material introducted in the mixing housing by said first conveyor.

Other objects may be found in the following specification, claims and drawings.

BRIEF DESCRIPTION OF THE DRAWINGS

The invention is illustrated more or less diagramatically in the following drawings wherein.

DESCRIPTION OF THE PREFERRED EMBODIMENT

Figure 1:
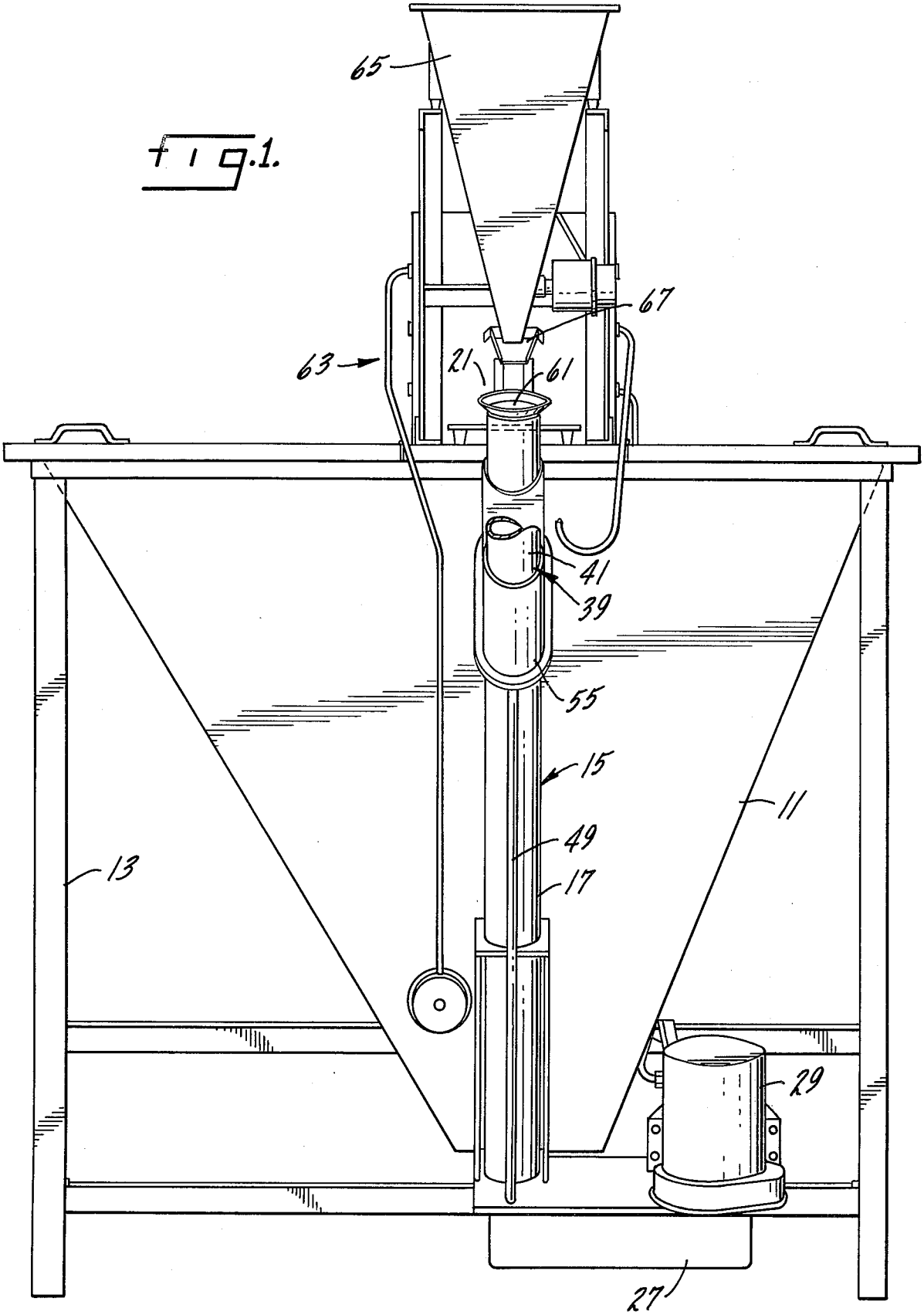
FIG. 1 is a front elevational view of mixing and conveying apparatus embodying the novel aspects of this invention.
Figure 2:
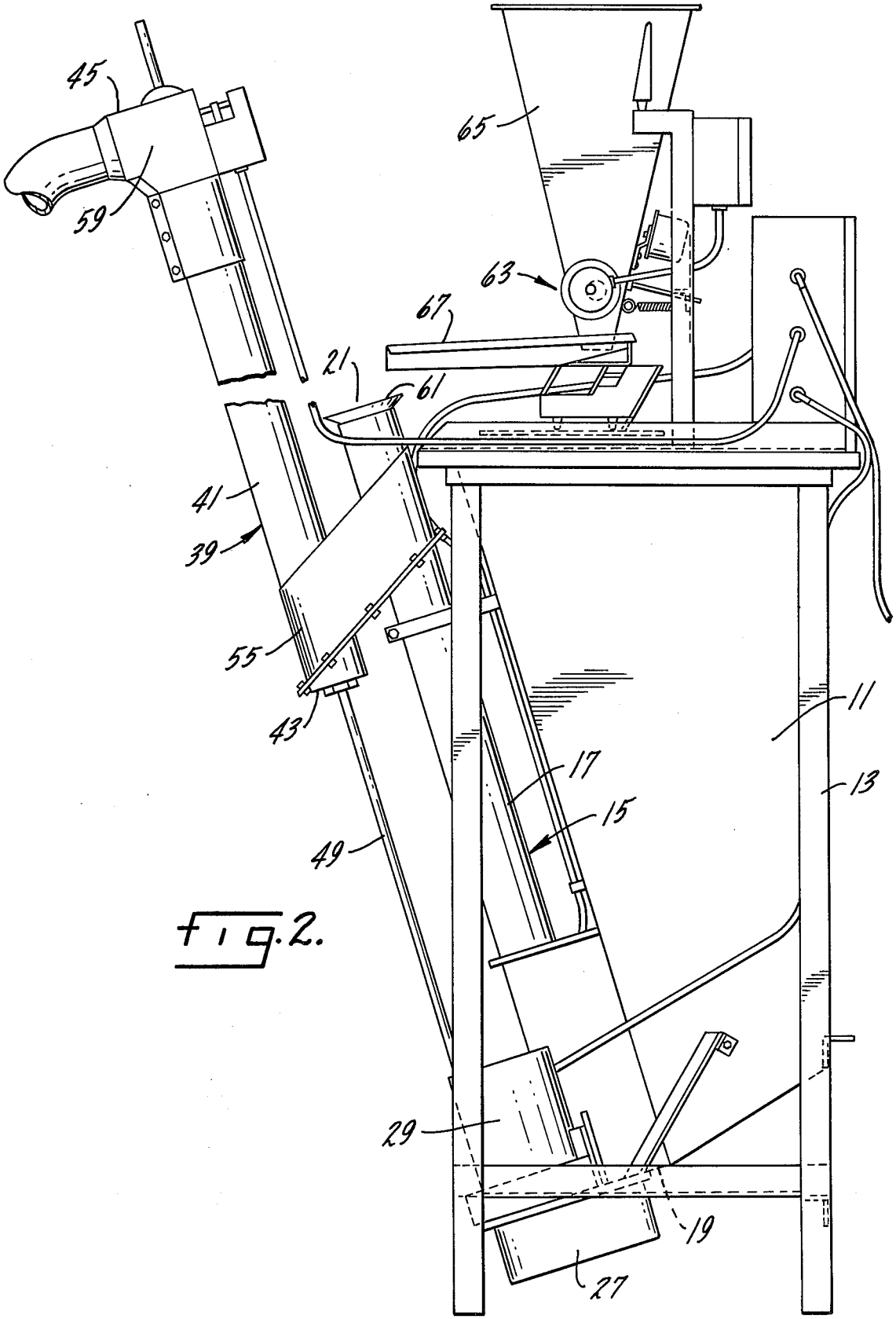
FIG. 2 is a side elevational view of the apparatus of FIG. 1.
Figure 3:
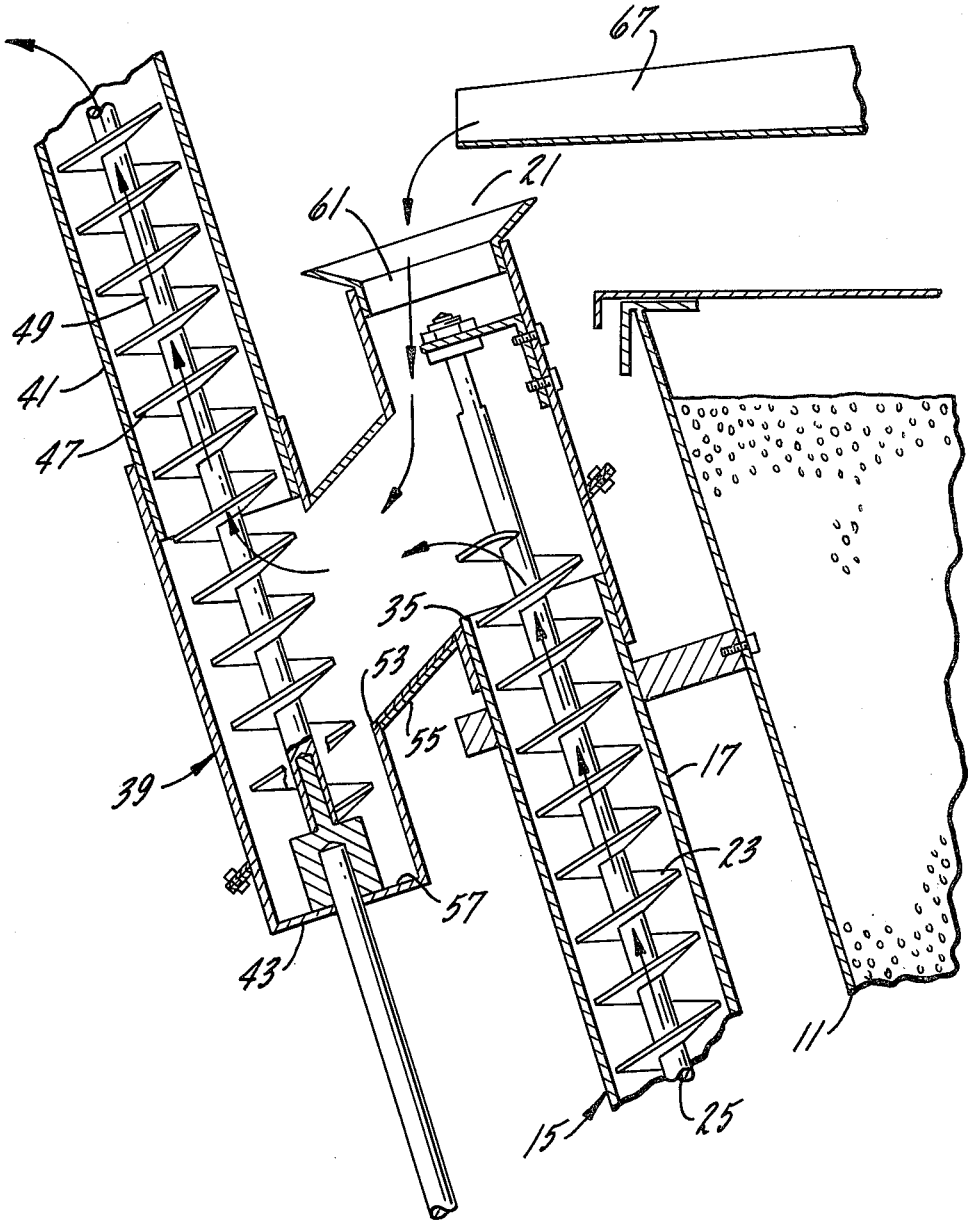
FIG. 3 is a partial enlarged cross-sectional view taken through the auger conveyors.

FIG. 1 shows a hopper 11 mounted on a framework 13. The hopper functions as a storage container for one of the dry materials to be conveyed and mixed by the apparatus of this invention. A first auger conveyor 15 is mounted on the framework 13 so that it extends in an upwardly inclined direction. The preferred angle of inclination relative to the horizontal is between 45° and 90°. As is conventional, auger conveyor 15 includes an elongated tubular housing 17 having lower and upper ends 19 and 21 respectively. As shown in FIG. 3, a helical auger blade 23 is mounted on a shaft 25 which is journalled in bearings mounted at the lower and upper ends of the tubular housing. The auger blade and shaft are driven through a sprocket and chain mechanism 27 which connects to the lower end of the shaft 25 with the chain operatively attached to an electric drive motor 29.

The auger conveyor 15 has an inlet (not shown) at the lower end thereof which connects to the hopper 11 near the bottom thereof. The auger conveyor has an outlet 35 which is located near the upper end 21 of the tubular housing 17 and opens through the side of the tubular housing somewhat below the upper end. The auger blade 23 terminates short of the upper end 21 of the tubular housing but extends slightly above the lower end of the outlet 35 in the manner shown in FIG. 3 of the drawings. The outlet 35 is located on the downwardly facing side of the inclined tubular housing 17.

A second upwardly inclined auger conveyor 39 is mounted along side the first auger conveyor 15 and extends generally parallel thereto. This auger conveyor includes an elongated tubular housing 41 which is closed by a lower end wall 43 and an upper end wall 45. A helical auger blade 47 is mounted on a shaft 49. The shaft is journalled in bearings located in the lower and upper end walls 43 and 45. Shaft 49 extends below the lower end wall 43 and is equipped with a sprocket which meshes with the chain drive 27 which is driven by the electric drive motor 29. The sprocket on shaft 49 is smaller than the sprocket on shaft 25 so that shaft 49 rotates at a faster speed than shaft 25.

An inlet 53 for the second auger conveyor is formed in an upwardly facing portion of the tubular housing 41 and is located below the outlet 35 of the auger conveyor 15. An inclined housing 55 of generally rectangular cross section connects the outlet 35 of the auger conveyor 15 to the inlet 53 of the auger conveyor 39. The inlet 53 of the elongated tubular housing 41 is located above the lower end wall 43 of the conveyor housing, thereby forming a reservoir 57 in the bottom of the tubular housing. The internal diameter of the reservoir portion 57 of the tubular housing 41 is slightly greater than the internal diameter of the remainder of the housing. This provides the reservoir with a greater clearance between its walls and the edges of the helical auger blade 47. The greater clearance in this portion of the conveyor permits greater slippage and churning of the materials and therefore provides some additional mixing capability during conveying.

An outlet 59 for the auger conveyor 39 is located at the upper end thereof and is considerably higher than the upper end of the auger conveyor 15 so that the material discharging from the auger conveyor 15 can discharge into the inlet or storage hopper in an elevated position.

An opening 61 for introducing one or more materials into the inclined housing 55 is formed in the upper end wall 21 of the conveyor housing 17. The opening 61 leads into the tubular housing 17 and then into the inclined housing 55 connecting the auger conveyors 15 and 39. The additional materials are fed into the opening 61 by one or more vibratory feeders 63 which are mounted on top of the hopper 11. For clarity of illustration, only one vibratory feeder is shown and described. However, it should be understood that a separate vibratory feeder may be provided for each material that is added through opening 61. The vibratory feeder is preferably adjustable to permit varying the quantity of the material added through the opening 61. As shown in the drawings, the vibratory feeder has its own hopper 65 for storage of its material. This material is fed in measured amounts to a vibrating feeder tray 67 which discharges the material into the opening 61.

The use, operation and function of this invention are as follows:

The apparatus shown and described herein is designed for conveying and mixing dry materials which may be either similar or dissimilar. It is specifically intended for conveying and mixing materials of the type used in the injection molding of plastic articles. These materials may be in the form of granules or powders. Additionally, other materials such as lubricants, fillers, tracers, or any other of the myriad substances which are found in molded plastics may be conveyed and mixed by the apparatus of this invention.

The material, usually granular, which is stored in the hopper 11 may conveniently be a thermoplastic material in a granular form such as polyethelene, polypropylene, styrene, etc. This material is usually in the form of small pellets which may be rectangular, oblong, spherical or cylindrical in shape. The pellets generally have maximum dimensions in the range of one-eighth of an inch. Material of this type is extensively used in the plastic molding industry and the type and characteristics of the materials may be varied in accordance with manufacturing and product considerations.

The upwardly inclined auger conveyor moves this material out of the hopper 11 and through the elongated tubular housing 17 until it reaches the housing outlet 35. The diameter of the helical auger blade 23 and the speed of rotation of the shaft 25 are cordinated to move a predetermined, measured, amount of this material through the auger conveyor 15 per selected time interval. Since the auger blade 23 terminates slightly above the lower edge of the outlet 35, the material is spun off or cascades into the inclined mixing housing 55 which leads to the inlet 53 of the second auger conveyor 53.

One or more additional materials are added to the first material as it cascades through the inclined housing 55. For example, the additional material may be a color impregnated concentrate which adds the desired coloring to the first granular material. The base composition of this impregnated concentrate will be the same as the composition of the first granular material or at least compatible therewith. For example, if the first granular material is polyethelene, the base composition of the color impregnated material will also be polyethelene. Instead of the color impregnated concentrate, "dry color" which is a powder, may be added to the first material. In addition, other materials such as regrinds, within limits, lubricants, tracers, fillers, etc. may be added to the first material as it cascades through the housing 55. The additional material or materials are added through the opening 61 in the upper end 21 of the auger conveyor housing 17. This material falls by gravity through the tubular housing 17 and into the inclined housing 55 where it mixes with the first material which is moving upwardly and outwardly into the mixing housing 55 by action of the auger conveyor blade 23. The additional materials are added through the opening 61 in a predetermined ratio by weight to the first material. The amount of each of the additional materials is closely controlled by the operation of a vibrating feeder tray 67 which is supplied by the hopper 65 of a vibratory feeder 63 located on top of the hopper 11. In some applications, a desired rate of three pounds of a granular color impregnated concentrate to 100 pounds of the first material is maintained. However, this ratio can vary from one and a half to five pounds to one hundred pounds depending on the characteristics that are desirable in the finished product.

After mixing by gravity and impact in the inclined housing 55, the mixture of the materials falls into the reservoir 57 at the bottom of the second auger conveyor 39. This auger conveyor assists the mixing of the materials in the inclined housing 55. The auger conveyor 39 has greater capacity than that of the auger conveyor 15. This greater capacity may be obtained in several ways. One way is to make the diameter of the auger blade 47 greater than that of the auger blade 23. However, in this embodiment, both auger blades are of the same diameter, but the auger shaft 49 is rotated at a higher speed than the auger shaft 25. The greater capacity of the second auger conveyor causes a cavitation or draft in the inclined cylindrical housing 55 which aids in the mixing of the materials. Some additional mixing is also obtained in the reservoir 57 which is larger in diameter than the remaining portion of the elongated tubular housing 41 of the auger conveyor 39. Thus, in the reservoir portion of the tubular housing, there is greater clearance between the auger blade and wall and, therefore, more slippage and mixing of the materials.

The auger conveyor 39 discharges through its outlet 59 to a hopper or storage container of the type which could supply an injection molding machine. Of course, the outlet 59 could discharge directly into the intake of an injection molding machine.

Whereas a preferred form of apparatus embodying the novel aspects of this invention has been shown and described herein, it should be understood that these are many changes and modifications which may be made to the apparatus shown and described without departing from the teachings of this invention. Therefore, the scope of this invention should be interpreted broadly in accordance with the claims appended hereto.

We claim:

1. A mixing and conveying apparatus for dry materials including:

a first auger conveyor for transporting a first dry material with said conveyor extending in a generally upright direction and having its inlet near the lower end thereof and its outlet near the upper end thereof, a second auger conveyor extending in a direction generally parallel to said first conveyor and having its inlet near the lower end thereof and its outlet near the upper end thereof with the inlet of said second conveyor being lower than the outlet of said first conveyor, a downwardly extending chamber connecting the outlet of said first conveyor with the inlet of said second conveyor, said first conveyor arranged to discharge said first dry material into said chamber through its outlet in an upwardly direction, and an opening into said chamber for the introduction of at least one additional dry material with said opening located to permit said additional dry material to move in a downwardly direction into said chamber and to mix with said first dry material before said materials reach the inlet of said second conveyor, said opening being located above the outlet of said first conveyor.

2. The mixing and conveying apparatus of claim 1 in which the opening into said chamber for the introduction of at least one additional dry material is located at the upper end of said first conveyor.

3. The mixing and conveying apparatus of claim 1 in which said first auger conveyor includes an auger blade located in a tubular housing having a tubular wall, said outlet for said conveyor is located in the wall of said tubular housing near one end thereof, said opening for the introduction of at least one additional dry material is located in the upper end of wall of said tubular housing above said outlet, and said auger blade terminates at said outlet.

4. The mixing and conveying apparatus of claim 1 in which the transporting capacity of said second auger conveyor is greater than the transporting capacity of said first auger conveyor.

* * * * *